United States Patent [19]

Rauch, III et al.

[11] Patent Number: 4,518,275

[45] Date of Patent: May 21, 1985

[54] PACKAGE AND STORAGE CONTAINER FOR DISKETTES

[75] Inventors: Cloyd D. Rauch, III, Beaverton; Ronald W. Schneberger, Troutdale, both of Oreg.

[73] Assignee: Rundel Products, Inc., Portland, Oreg.

[21] Appl. No.: 511,765

[22] Filed: Jul. 7, 1983

[51] Int. Cl.[3] ..... B42F 13/00; B42F 5/00; B65D 19/04; B42D 15/00

[52] U.S. Cl. ..... 402/80 P; 206/387; 283/111; 40/405

[58] Field of Search ..... 402/80, 8 R, 75; 281/42; D9/432, 426; 40/405; 206/387

[56] References Cited

U.S. PATENT DOCUMENTS

| | | | |
|---|---|---|---|
| D. 217,107 | 4/1970 | Cassidy et al. | D9/426 |
| D. 268,098 | 3/1983 | Brown | D9/432 |
| D. 363,561 | 3/1982 | Wong | D9/432 |
| 2,989,023 | 6/1961 | Ellingsen | 281/42 |
| 3,596,822 | 8/1971 | Holley | D9/426 |
| 3,896,929 | 7/1975 | Mills | 206/387 |
| 3,910,708 | 10/1975 | Rohner | 402/80 R |
| 4,294,558 | 10/1981 | Errichiello | 402/75 |

FOREIGN PATENT DOCUMENTS

| | | | |
|---|---|---|---|
| 2248693 | 5/1975 | France | 40/405 |

*Primary Examiner*—Paul A. Bell
*Assistant Examiner*—Paul M. Heyrana, Sr.
*Attorney, Agent, or Firm*—Robert L. Harrington

[57] ABSTRACT

A container for computer software diskettes and instructional materials. The top and bottom covers are interconnected along one edge through a semi-rigid back and have wall sections along the other three edges. The wall sections are in abutment with the covers closed together whereby a substantially enclosed cavity is defined by the back, wall sections and top and bottom covers. A three ring binder unit provided along the connected edge of the bottom cover is adapted to hold the instructional materials and a pocket provided on the top cover is adapted to hold the diskettes.

9 Claims, 7 Drawing Figures

PACKAGE AND STORAGE CONTAINER FOR DISKETTES

FIELD OF INVENTION

This invention relates to containers for diskettes that satisfy the functions of a holder for the diskette, a ring binder for the literature that accompanies the diskette, and a protective shield for the diskette.

BACKGROUND OF THE INVENTION

With the advent of computers targeted for small and medium sized company use, the market for "canned" programs to run these computers has become substantial. A common type of canned program is one that is magnetically recorded on a diskette that is adapted to be played on a floppy disk recorder that inputs the recorded program to the computer. These diskettes are sold as off-the-shelf items. A user simply determines which programs are most suitable for his needs and equipment, and purchases an appropriate diskette from a software sales outlet.

There are several factors that determine the manner in which these diskettes are distributed and stored. The diskettes, or at least the information contained on the diskettes, is valuable and expensive to purchase. The magnetic recording on the surface of the disk is highly sensitive and can be easily damaged. Thus a lot of attention is given to protecting the diskette during handling and storage. Secondly, the information on the recording is useable only with proper instruction provided by literature that accompanies the diskette. It is highly preferable that this literature be kept in the storage unit to be readily accessible to the user.

Heretofore the typical package and storage container for the diskette and literature consisted of two parts. The first part consisted of a slightly modified loose leaf ring binder equipped with a pocket on the inside of one cover for the diskette. The literature is mounted on the rings in the conventional manner. The second part consisted of a rigid shield or casing resembling an open ended box in which the ring binder is inserted. The back of the binder substantially closed the open end of the casing and the contents therein were substantially protected against crushing and contact from outside sources.

Not as popular but also available as a container for diskettes is a casing which resembles a rectangular box split lengthwise. The halves are hinged together like a book and when closed together form a protective enclosure. When opened, each half forms an open walled-in cavity one side of which is adapted to contain the diskette and the other the literature. Plastic strips or pockets hold the diskette and literature within their respective cavities. In the case of the two part container, the literature is organized and the diskette is both available with the container open and protected with the container closed. However, the two parts of the container are cumbersome and expensive. In the case of the split box, the literature is loose and thus easily separated from the container and is not readily available for reference without first removing it from the container.

BRIEF DESCRIPTION OF THE INVENTION

The present invention is believed to substantially improve the prior containers for diskettes by providing a one part container that incorporates a ring binder within a box-like configuration. The diskette is well protected without a separate sleeve or casing and the literature is readily available without removing it from the container.

DETAILED DESCRIPTION INCLUDING DRAWING

A detailed description of a preferred embodiment of the invention is set forth hereafter. The drawings referred to include the following figures.

Figure 2:
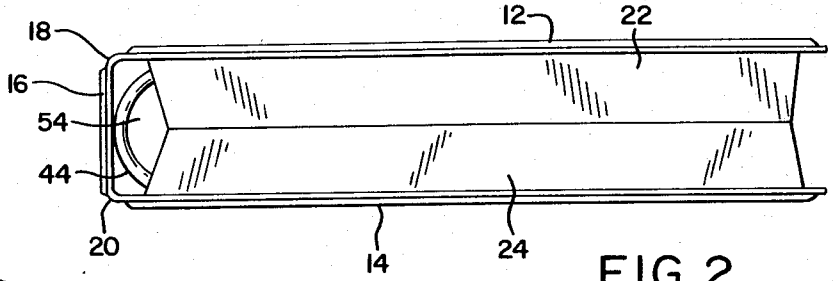
FIG. 2 is an end view of the container of FIG. 1 in a closed condition.

Referring to the drawings, a container 10 consists of a substantially rigid (semi-rigid) top cover 12, a substantially rigid bottom cover 14 and a substantially rigid back 16. The back 16 is connected along one edge 18 to a side edge of the top cover 12 and along the opposite edge 20 to a side edge of the bottom cover 14. These edge connections are achieved by an electronic heat-sealing process that essentially "welds" the vinyl of the covers and back together forming flexible "hinges" that allow the container to be fully opened with the covers and back laid flat on a counter top or the like.

Each of the top and bottom covers is provided with inwardly projected wall sections 22 and 24 respectively that extend continuously along the other three edges. These wall sections 22 and 24 have a combined depth equal to the width of the back 16, and are constructed so that the outer edges 26 and 28 of the top and bottom wall sections respectively are brought into abutment when the container is closed. Thus the container when closed assumes the shape of a rectangular box having a height established by the width of back 16 and the combined depth of wall sections 22 and 24.

Means for releasably fastening the two covers together in a closed position is provided by embossments 30 formed on edge 26 and depressions 32 formed on edge 28. The embossments 30 are adapted to mate with the depressions 32 whereby an interference fit is achieved and opening of the container is resisted. A rib 31 along edge 26 other than where the embossments are positioned, fits into a channel 33 along edge 28 other than where the depressions 32 are positioned. This interfit of the edges 26 and 28 insures a relatively dust free closure.

Figure 4:
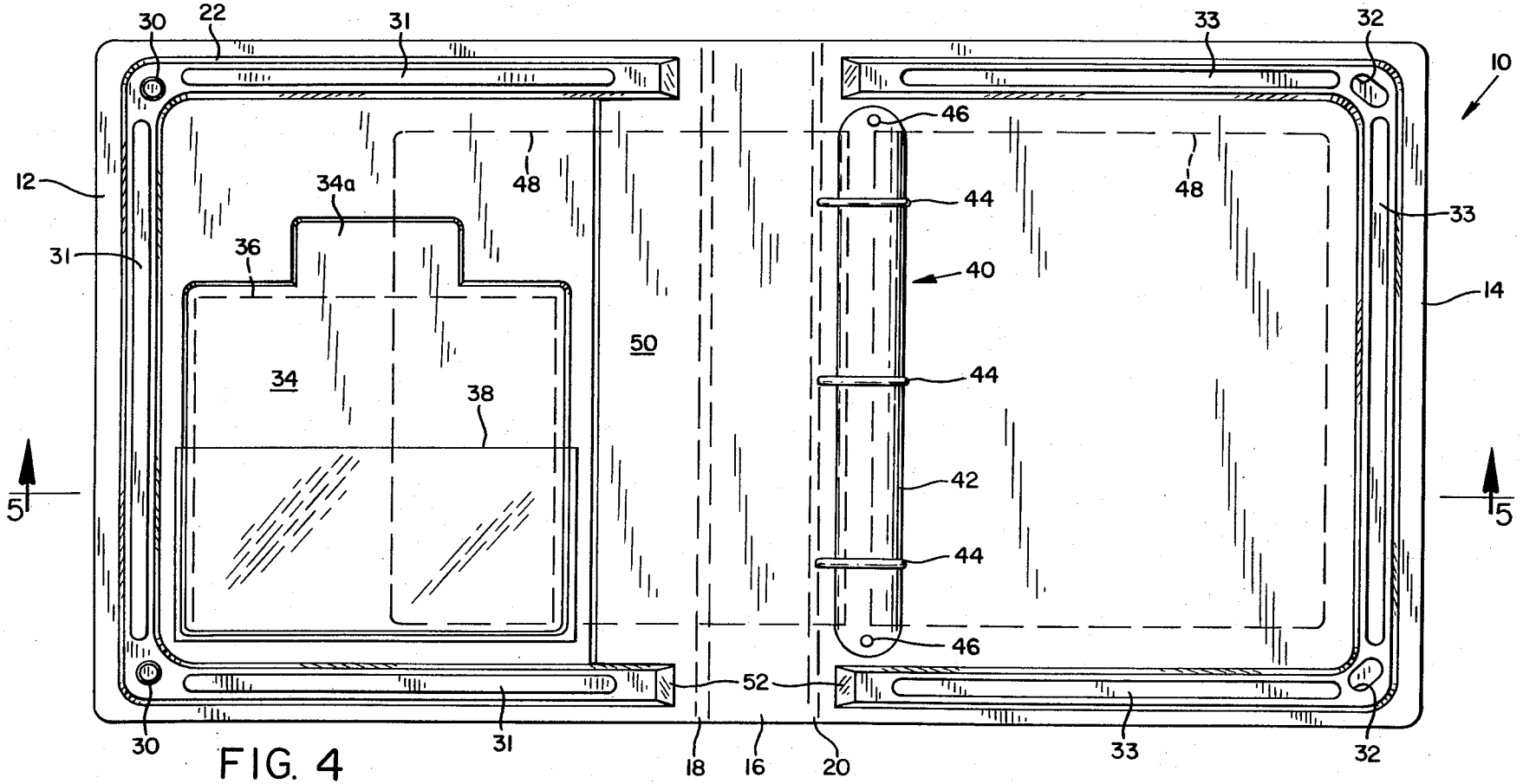
FIG. 4 is a plan view of the opened container illustrating a diskette and instructional materials in dashed lines.

The inside of top cover 12 is provided with a depression 34 that is the approximate size of a diskette 36 outlined in FIG. 4. (The cover thickness in the area of the depression 34 is increased to accomodate the formation of this depression.) A holding strap 38, e.g., of clear plastic, spans the width of depression 34 and holds the diskette within the depression. The inside of the bottom cover 14 is provided with a binder ring unit 40. This unit is of common construction and includes a base 42 and three D type rings 44 adapted to open and close, e.g., for receiving instructional materials on sheets having corresponding pre-punched holes. The D rings open and close in unison and when closed resist opening, all controlled by a mechanism within the base 42, which, as explained is well known to the binder art. The base 42 is positioned along the inside edge of the bottom cover 14 by rivets 46 as shown, and the flat sides of the rings face the bottom cover to which the unit is attached.

A diskette container of the present invention that is in actual use was constructed by the vacuform process and formed of semi-rigid molded plastic. The closed case is approximatey 10 inches long, 9 inches wide, and 2 inches deep. The top cover has a wall section 22 of about $\frac{5}{8}$ inch in height (measured on the outside of the wall). The thickened portion inside the wall 22 is formed with a 3/16 inch depression that forms a cavity that is about $5\frac{1}{2}$ inches wide and $5\frac{1}{4}$ inches long (to accomodate a $5\frac{1}{4}$ inch diameter diskette). A clear plastic strap 3 inches by 6 inches spans the depression and is fastened as by electronic heat sealing. An upper extension 34*a* of the depression 34 allows the user to slip a finger under the edge of the diskette for removal. The thickness of the cover is reduced along the inner edge to provide relief 50 for the rings 44 when the case is closed.

The wall section 24 of the bottom cover is about $\frac{7}{8}$ inch in height outside and inside the wall section. The space defined by the ring biner unit and wall section 24 accomodates instruction material on a standard sheet size of $8\frac{1}{2}$ inches by $5\frac{1}{2}$ inches. The rings are spaced a conventional $2\frac{3}{4}$ inches apart and the total height of the base and rings is $1\frac{1}{2}$ inches (to just fit within the space established by the combined wall section heights).

The container was designed to accomodate up to three diskettes. The diskettes are inserted under strap 38 within the depression 34 to be securely held until removal. The appropriate instructions printed on e.g., pre-punched $8\frac{1}{2}$ inch by $5\frac{1}{2}$ inch sheets 48 (in dashed lines) are inserted onto the rings to be securely held in the desired order. The two covers are snapped together to be secured by the frictional engagement of embossments 36 in depression 34, and with the tongue and groove interfit of rib 34 in channel 36 sealing out dust and the like. (A secondary seal may be desired for shipping to be removed and discarded by the purchaser-/user).

Figure 1:
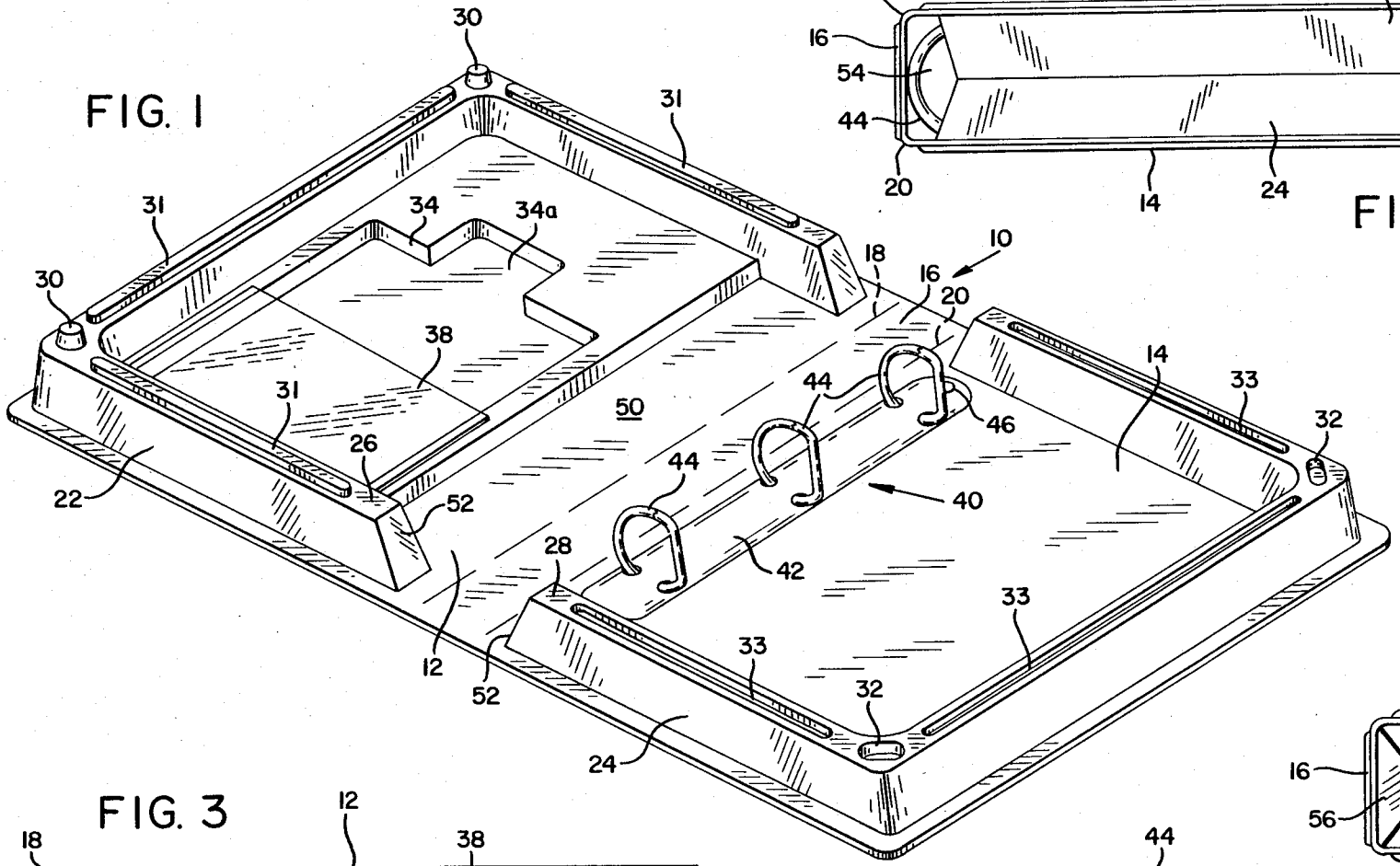
FIG. 1 is a perspective view of a container for diskettes in accordance with the present invention.
Figure 5:
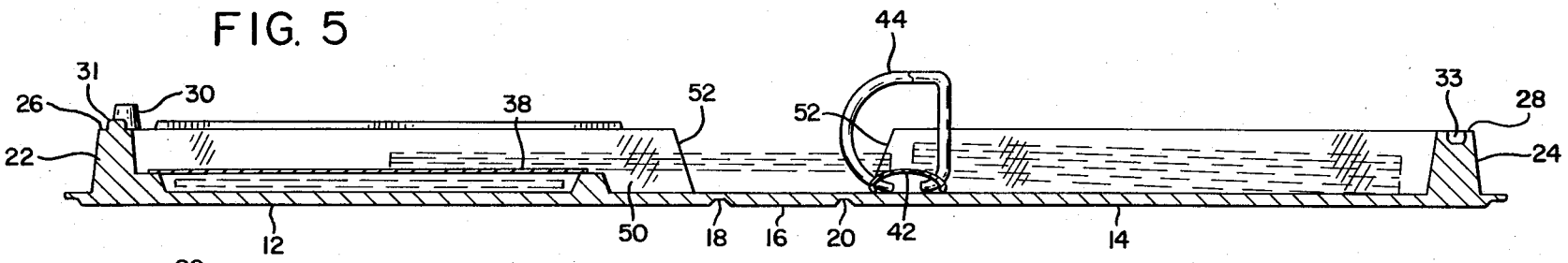
FIG. 5 is a sectional view taken on lines 5—5 of FIG. 4.

The user has ready access to both the diskettes and reading material which, as will be observed from FIGS. 1, 4 and 5 can be laid open flat. The sheets can be paged through as desired, in the manner of a book, without removing any of the sheets. Yet the case can be closed and the rigid shield that the covers form around the material securely protects the diskettes from damage. In the closed condition the container is easily stored on a shelf.

Alternate Embodiment

Figure 7:
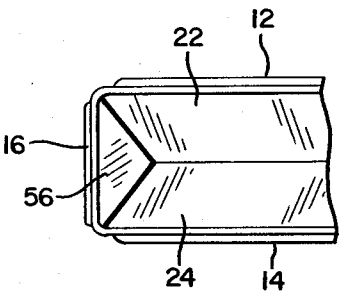
FIGS. 6 and 7 are partial end views of an alternate embodiment of the container in open and closed positions respectively.
Figure 6:
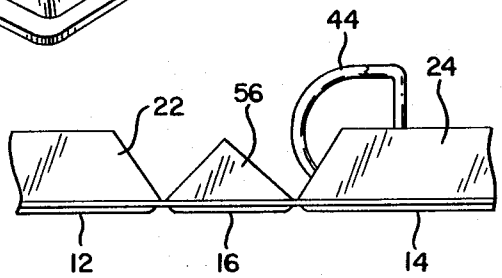
Figure 3:
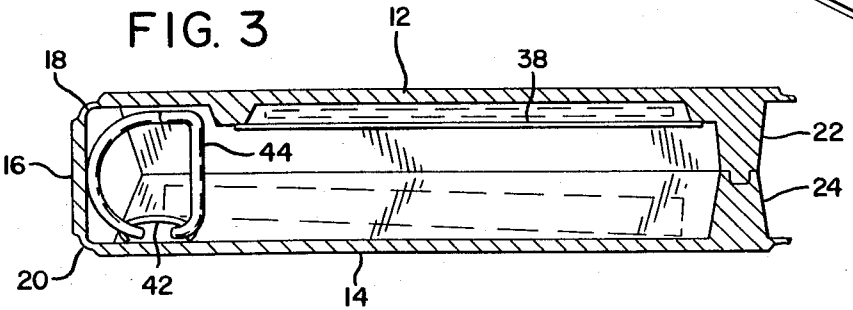
FIG. 3 is a sectional view of the closed container similar to FIG. 2.

It will be noted that the interior of the case is not totally dust sealed when closed. This is due to the angled ends 52 of the wall sections 22 and 24. These angled ends permit the relative pivoting of the covers without interference as might be the case if the ends were made square. Thus the covers when closed define a triangular shaped opening 54. This opening can be closed off by the provision of triangular shaped end pieces 56 molded to the back 16 as shown in FIGS. 6 and 7. End pieces 56 do not interfere with the closing function but fill opening 54 when the covers are closed.

Other variations, modifications and improvements may be developed by those skilled in the art without departing from the present invention as defined by the accompanying claims.

We claim:

1. A container for computer software diskettes comprising: a top cover, a bottom cover and back hingedly connected along one edge to a corresponding edge of the top cover and along the opposite edge to a corresponding edge of the bottom cover, a wall section provided on the inside of each of said top and bottom covers along the unconnected edges thereof, said wall sections extending inwardly and defining an enclosued cavity with the covers folded together, fastening means for releasably fastening the covers together in the closed position, a pocket provided on the inside of the top cover, said pocket being formed by a depression in the wall thickness of the top cover and being shaped to accommodate the diskette, and a strap spanning the depression for holding a diskette within the depression, and a binder ring unit attached along the connected edge inside the bottom cover, said binder ring unit adapted to receive instructional materials for securely storing such materials with the container closed and for easy access and reference without removal with the container open and laid flat.

2. A container for computer software diskettes as defined in claim 1 wherein the wall sections are positioned with their edges in abutment with the covers folded together, said fastening means comprising embossments formed on the inner edge of a wall section of one of said covers and mating depressions formed on the inner edge of the wall section of the other of said covers, said mated embossments and depressions being frictionally engaged with the covers in a closed position whereby opening of the covers is resisted.

3. A container for computer software diskettes as defined in claim 2 wherein a thickened section is provided on the inside of the top cover, with the depression formed therein to accommodate a diskette, and a transparent strap spanning the depression and attached at both ends and bottom to the cover to hold a diskette in that depression while providing visual awareness of the diskette contained in the pocket.

4. A container for computer software diskettes as defined in claim 3 wherein one of said wall sections includes a rib along the entire inside edge other than the locations of the embossments, and the other wall section including a mating channel along the entire inside edge other than the locations of the depressions, said rib being seated in the channel with the covers in closed position to aide in sealing the interior of the container.

5. A container for computer software diskettes as defined in claim 4 wherein the binder ring unit is comprised of three D shaped rings having the flat sides of the ring facing toward the cover to which it is attached.

6. A container for computer software diskettes as defined in claim 1 wherein the wall sections cooperatively extend continuously along the cover edges other than the edges connected to the back, said edges connected to the back being free of wall sections whereby folding of the covers produces a substantially enclosed cavity defined by the back along the connected edge and the cooperating wall sections along the other edges.

7. A container for computer software diskettes as defined in claim 1 wherein the hinged connection on each side of the back is provided by a flexible strip of material integral with and extended along the entire connected edges of the back and covers, and the wall section extended substantially along the entire other edges of the respective covers whereby closure of the container substantially completely encloses the interior of the container.

8. A container for computer software diskettes as defined in claim 6 wherein the covers, back, and wall sections are formed of semi-rigid plastic in the vacuform process.

9. A container for computer software diskettes as defined in claim 4 wherein the wall sections end at each point where the wall sections intersect with the connected edge, said ends being angled rearwardly from said intersection whereby a triangular shaped opening is formed by the back and wall sections when the container is closed.

* * * * *